US012037767B2

(12) United States Patent
Konda et al.

(10) Patent No.: US 12,037,767 B2
(45) Date of Patent: Jul. 16, 2024

(54) WORK MACHINE AND METHOD FOR CONTROLLING THE SAME

(71) Applicant: KOMATSU LTD., Tokyo (JP)

(72) Inventors: Tomoki Konda, Tokyo (JP); Kenjiro Shimada, Tokyo (JP); Kazuhiro Hatake, Tokyo (JP); Yusuke Saigo, Tokyo (JP)

(73) Assignee: KOMATSU LTD., Tokyo (JP)

( * ) Notice: Subject to any disclaimer, the term of this patent is extended or adjusted under 35 U.S.C. 154(b) by 388 days.

(21) Appl. No.: 17/440,922

(22) PCT Filed: May 22, 2020

(86) PCT No.: PCT/JP2020/020269
§ 371 (c)(1),
(2) Date: Sep. 20, 2021

(87) PCT Pub. No.: WO2020/255622
PCT Pub. Date: Dec. 24, 2020

(65) Prior Publication Data

US 2022/0162832 A1 May 26, 2022

(30) Foreign Application Priority Data

Jun. 19, 2019 (JP) ..... 2019-113951

(51) Int. Cl.
*E02F 9/10* (2006.01)
*E02F 9/26* (2006.01)
*E02F 3/32* (2006.01)

(52) U.S. Cl.
CPC ..... *E02F 9/10* (2013.01); *E02F 9/26* (2013.01); *E02F 3/32* (2013.01)

(58) Field of Classification Search
CPC ..... E02F 9/10; E02F 9/26; E02F 3/32
See application file for complete search history.

(56) References Cited

U.S. PATENT DOCUMENTS

| | | | | |
|---|---|---|---|---|
| 3,899,028 | A * | 8/1975 | Morris | E02F 3/845 172/4.5 |
| 7,979,182 | B2 * | 7/2011 | Ooki | E02F 9/2296 701/50 |
| 10,900,201 | B2 * | 1/2021 | Shintani | G01C 9/04 |
| 2010/0222970 | A1 | 9/2010 | Shono et al. | |
| 2014/0297040 | A1 | 10/2014 | Baba et al. | |
| 2016/0244950 | A1 * | 8/2016 | Kami | E02F 9/265 |

(Continued)

FOREIGN PATENT DOCUMENTS

| | | |
|---|---|---|
| CN | 105986593 A | 10/2016 |
| JP | H08-265625 A | 10/1996 |

(Continued)

*Primary Examiner* — Gertrude Arthur Jeanglaude
(74) *Attorney, Agent, or Firm* — Faegre Drinker Biddle & Reath LLP

(57) ABSTRACT

A work machine comprises: a travel unit; a swing unit provided on the travel unit swingably; an angular velocity sensor that is attached to the swing unit and outputs an azimuthal angular velocity of the swing unit; a measurement device that measures an azimuth of the swing unit; and a controller that corrects the azimuthal angular velocity based on azimuth information measured by the measurement device and controls the swing unit based on the corrected azimuthal angular velocity.

5 Claims, 7 Drawing Sheets

(56) References Cited

U.S. PATENT DOCUMENTS

| | | | | |
|---|---|---|---|---|
| 2016/0348343 | A1* | 12/2016 | Kanemitsu | G01S 19/14 |
| 2019/0360174 | A1* | 11/2019 | Kawamoto | G01S 5/163 |

FOREIGN PATENT DOCUMENTS

| | | | |
|---|---|---|---|
| JP | 2015-007370 | A | 1/2015 |
| JP | 2017-122602 | A | 7/2017 |
| KR | 10-2010-0072259 | A | 6/2010 |
| KR | 10-2015-0013903 | A | 5/2015 |
| WO | WO-2015/181989 | A1 | 12/2015 |

* cited by examiner

WORK MACHINE AND METHOD FOR CONTROLLING THE SAME

TECHNICAL FIELD

The present disclosure relates to controlling swinging of a work machine.

BACKGROUND ART

A work vehicle such as a hydraulic excavator has conventionally been known. For example, Japanese Patent Laid-Open No. 2017-122602 (PTL 1) discloses an excavator that derives a swing angle of a swing unit based on an output of an inertia measurement device such as a gyro sensor attached to the swing unit.

CITATION LIST

Patent Literature

PTL 1: Japanese Patent Laid-Open No. 2017-122602

SUMMARY OF INVENTION

Technical Problem

The inertia measurement device is, however, highly dependent on environment and may cause error in sensitivity. In that case, there is a possibility that an error occurs in deriving a swing angle, and there is a possibility that highly accurate swing control cannot be executed.

An object of the present disclosure is to provide a work machine and a method for controlling the work machine, that allow highly accurate swing control.

Solution to Problem

A work machine according to an aspect of the present disclosure comprises: a travel unit; a swing unit provided on the travel unit swingably; an angular velocity sensor that is attached to the swing unit and outputs an azimuthal angular velocity of the swing unit; a measurement device that measures an azimuth of the swing unit; and a controller that corrects the azimuthal angular velocity based on azimuth information measured by the measurement device and controls the swing unit based on the corrected azimuthal angular velocity.

Preferably, the controller calculates a reference swing angle based on an azimuth of the swing unit as measured by the measurement device before the swing unit starts to swing and an azimuth of the swing unit as measured by the measurement device after the swing unit ends swinging.

Preferably, the controller calculates an expected swing angle based on the azimuthal angular velocity output by the angular velocity sensor and a swing operation time of the swing unit, and calculates a correction coefficient based on the reference swing angle and the expected swing angle to correct an output of the angular velocity sensor.

Preferably, the correction coefficient is a ratio of the expected swing angle to the reference swing angle. A method for controlling a work machine according to an aspect of the present disclosure comprises: detecting an azimuthal angular velocity by an angular velocity sensor attached to a swing unit provided on a travel unit swingably; measuring an azimuth of the swing unit; correcting the detected azimuthal angular velocity based on measured azimuth information of the swing unit; and controlling the swing unit based on the corrected azimuthal angular velocity.

Advantageous Effects of Invention

The presently disclosed work machine and method for controlling the work machine allows highly accurate swing control.

DESCRIPTION OF EMBODIMENTS

Hereinafter, an embodiment will be described with reference to the drawings. In the following description, identical components are identically denoted. Their names and functions are also identical. Accordingly, they will not be described repeatedly in detail.

<Overall Configuration of Work Machine>

Figure 1:
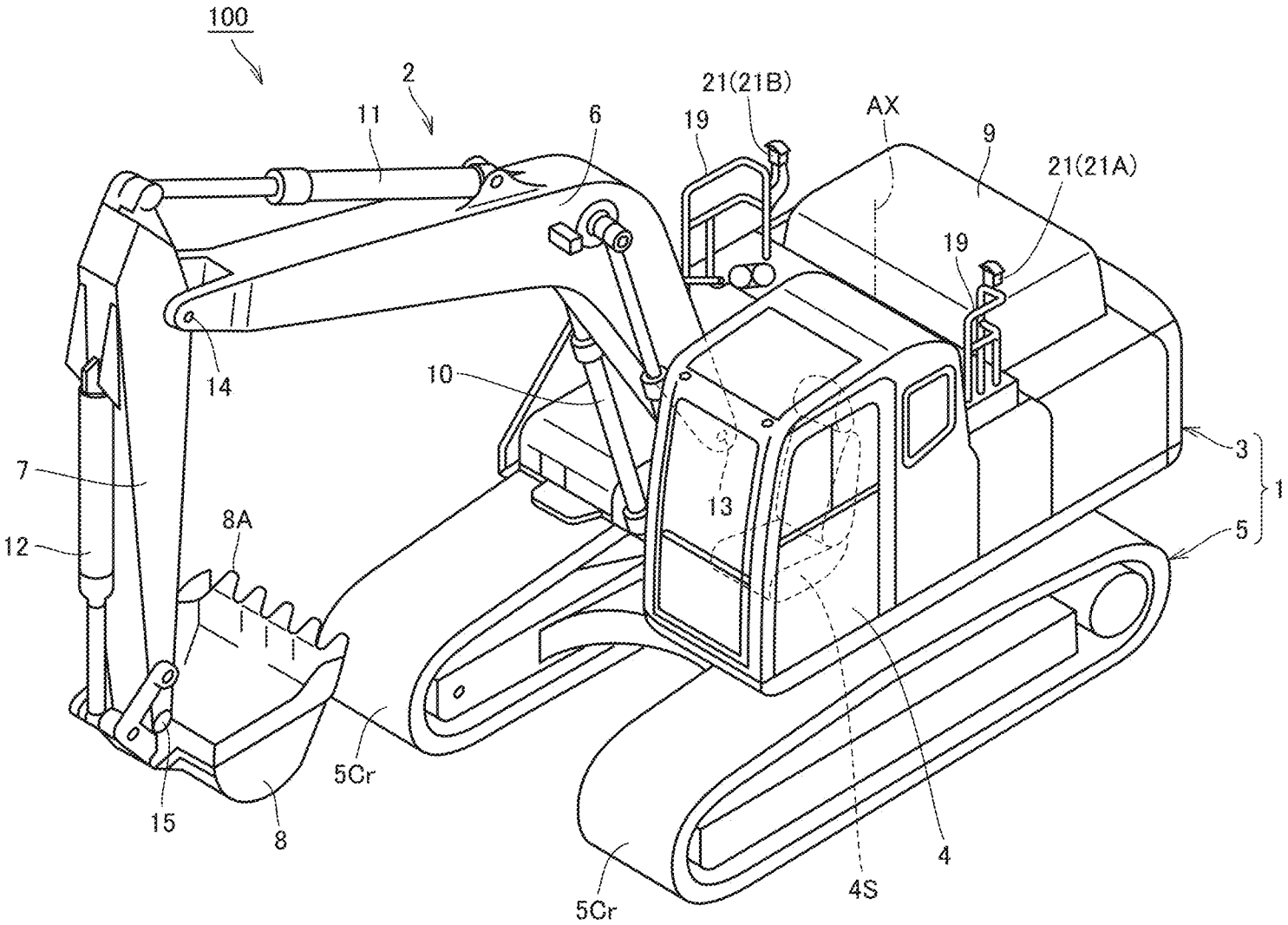
FIG. 1 is an external view of a work machine according to an embodiment.

FIG. 1 is an external view of a work machine according to an embodiment.

As shown in FIG. 1, a hydraulic excavator comprising a hydraulic work implement 2 will be described as an example of a work machine to which the concept of the present disclosure is applicable.

A work machine 100 comprises a vehicular body 1 and work implement 2. Vehicular body 1 includes a swing unit 3, a cab 4, and a traveling apparatus 5.

Swing unit 3 is disposed on traveling apparatus 5. Traveling apparatus 5 supports swing unit 3. Swing unit 3 can swing about a swing axis AX. An operator's seat 4S on which an operator is seated is provided in cab 4. The operator operates work machine 100 in cab 4. Traveling apparatus 5 has a pair of crawler belts 5Cr. Work machine 100 travels as crawler belts 5Cr rotate. Note that travelling apparatus 5 may be composed of vehicular wheels (or tires).

In a first embodiment, a positional relationship of each component will be described with reference to an operator seated on operator's seat 4S. A frontward/rearward direction is a direction frontwardly/rearwardly of the operator seated on operator's seat 4S. A rightward/leftward direction is a rightward/leftward direction with respect to the operator seated on operator's seat 4S. The rightward/leftward direction matches the vehicle's widthwise direction (a vehicular widthwise direction). When the operator is seated on operator's seat 4S and faces frontward, the operator faces in the frontward direction, and a direction opposite to the frontward direction is the rearward direction. When the operator is seated on operator's seat 4S and faces frontward, a direction on a right side of the operator is referred to as the rightward direction, and a direction on a left side of the operator is referred to as the leftward direction.

Swing unit 3 has an engine compartment 9 in which an engine is housed, and a counter weight provided at a rear portion of swing unit 3. Swing unit 3 is provided with a handrail 19 frontwardly of engine compartment 9. The engine, a hydraulic pump, etc. are disposed in engine compartment 9.

Work implement 2 is supported by swing unit 3. Work implement 2 has a boom 6, a dipper stick 7, a bucket 8, a boom cylinder 10, a dipper stick cylinder 11, and a bucket cylinder 12.

Boom 6 is connected to swing unit 3 via a boom pin 13. Dipper stick 7 is connected to boom 6 via a dipper stick pin 14. Bucket 8 is connected to dipper stick 7 via a bucket pin 15. Boom cylinder 10 drives boom 6. Dipper stick cylinder 11 drives dipper stick 7. Bucket cylinder 12 drives bucket 8. Boom 6 has a proximal end (or a boom foot) connected to swing unit 3. Boom 6 has a distal end (or a boom top) connected to a proximal end of dipper stick 7 (or a dipper stick foot). Dipper stick 7 has a distal end (or a dipper stick top) connected to a proximal end of bucket 8. Boom cylinder 10, dipper stick cylinder 11, and bucket cylinder 12 are each a hydraulic cylinder driven with hydraulic oil.

Boom 6 is pivotable with respect to swing unit 3 about boom pin 13 serving as a pivot. Dipper stick 7 is pivotable with respect to boom 6 about dipper stick pin 14 serving as a pivot parallel to boom pin 13. Bucket 8 is pivotable with respect to dipper stick 7 about bucket pin 15 serving as a pivot parallel to boom pin 13 and dipper stick pin 14.

Figure 2:
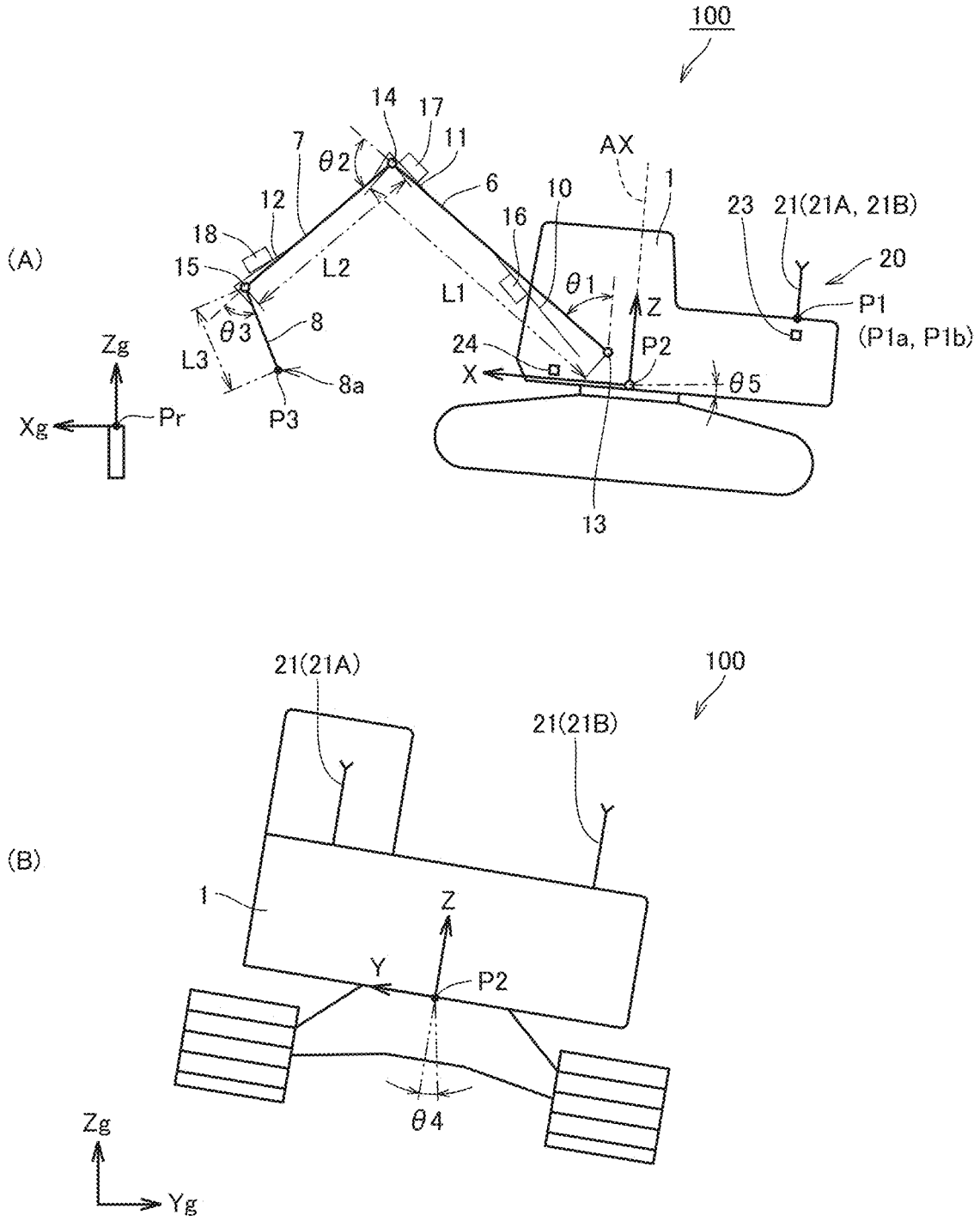
FIG. 2 is a diagram for schematically illustrating a work machine 100 according to an embodiment.

Note that travelling apparatus 5 and swing unit 3 are one example of a "travel unit" and a "swing unit," respectively, according to the present disclosure. FIG. 2 is a diagram for schematically illustrating work machine 100 according to an embodiment.

FIG. 2(A) is a side view of work machine 100. FIG. 2(B) is a rear view of work machine 100.

As shown in FIGS. 2(A) and 2(B), boom 6 has a length L1, which is a distance between boom pin 13 and dipper stick pin 14. Dipper stick 7 has a length L2, which is a distance between dipper stick pin 14 and bucket pin 15. Bucket 8 has a length L3, which is a distance between bucket pin 15 and teeth 8A of bucket 8. Bucket 8 has a plurality sharp edges, and in the present example, bucket 8 has a distal end, which will be referred to as teeth 8A.

Bucket 8 may not have a sharp edge. Bucket 8 may have the distal end formed of a steel plate having a straight shape.

Work machine 100 includes a boom cylinder stroke sensor 16, a dipper stick cylinder stroke sensor 17, and a bucket cylinder stroke sensor 18. Boom cylinder stroke sensor 16 is disposed at boom cylinder 10. Dipper stick cylinder stroke sensor 17 is disposed at dipper stick cylinder 11. Bucket cylinder stroke sensor 18 is disposed at bucket cylinder 12. Boom cylinder stroke sensor 16, dipper stick cylinder stroke sensor 17, and bucket cylinder stroke sensor 18 are also collectively referred to as a cylinder stroke sensor.

A stroke length of boom cylinder 10 is determined based on a result of detection by boom cylinder stroke sensor 16. A stroke length of dipper stick cylinder 11 is determined based on a result of detection by dipper stick cylinder stroke sensor 17. A stroke length of bucket cylinder 12 is determined based on a result of detection by bucket cylinder stroke sensor 18.

In the present example, the stroke lengths of boom, dipper stick and bucket cylinders 10, 11 and 12 are also referred to as a boom cylinder length, a dipper stick cylinder length, and a bucket cylinder length, respectively. In the present example, the boom cylinder length, the dipper stick cylinder length, and the bucket cylinder length are also collectively referred to as cylinder length data L. It is also possible to employ a method for detecting a stroke length by using an angle sensor.

Work machine 100 includes a position detection device 20 capable of detecting a position of work machine 100.

Position detection device 20 includes an antenna 21, a global coordinate computation unit 23, and an IMU (Inertial Measurement Unit) 24.

Antenna 21 is for example an antenna for GNSS (Global Navigation Satellite Systems). Antenna 21 is for example an antenna for RTK-GNSS (Real Time Kinematic-Global Navigation Satellite Systems).

Antenna 21 is provided on swing unit 3. In the present example, antenna 21 is provided on a handrail 19 of swing unit 3. Antenna 21 may be provided rearwardly of engine compartment 9. For example, antenna 21 may be provided on the counterweight of swing unit 3. Antenna 21 outputs to global coordinate computation unit 23 a signal corresponding to an electric wave received from a satellite (a GNSS electric wave).

Global coordinate computation unit 23 detects a position P1 at which antenna 21 is disposed in a global coordinate system. The global coordinate system is a three-dimensional coordinate system (Xg, Yg, Zg) based on a reference position Pr set in a work area. In the present example, reference position Pr is the position of a tip of a reference stake set in the work area. Further, a local coordinate system is a three-dimensional coordinate system represented by (X, Y, Z) with work machine 100 serving as a reference. The local coordinate system has a reference position, which is data indicating a reference position P2 located on the swing axis (or the center of swinging) AX of swing unit 3.

In the present example, antenna 21 has a first antenna 21A and a second antenna 21B provided on swing unit 3 and spaced from each other in the vehicular widthwise direction.

Global coordinate computation unit 23 detects a position P1*a* at which first antenna 21A is disposed and a position P1*b* at which second antenna 21B is disposed. Global coordinate computation unit 23 obtains reference position data P represented by global coordinates. In the present example, reference position data P is data indicating reference position P2 located on swing axis (or the center of swinging) AX of swing unit 3. Reference position data P may be data indicating position P1.

In the present example, global coordinate computation unit 23 generates the swing unit's azimuth data Q based on two positions P1*a* and P1*b*. The swing unit's azimuth data Q is determined based on an angle that a straight line determined by positions P1*a* and P1*b* forms with respect to a reference azimuth (e. g., north) for global coordinates. The swing unit's azimuth data Q indicates an azimuth which swing unit 3 (or work implement 2) faces. Global coordinate computation unit 23 outputs reference position data P and the swing unit's azimuth data Q to a work implement controller 26, which will be described hereinafter. Global coordinate computation unit 23 can generate and output the swing unit's azimuth data highly accurately when swing unit 3 is stationary. While in the present example a method will be described for calculating the swing unit's azimuth data by global coordinate computation unit 23 using a GNSS electric wave, this is not exclusive, and the swing unit's azimuth data may be calculated in another method. For example, a stereoscopic image may be used to obtain three-dimensional data to calculate the swing unit's azimuth data. It is also possible to calculate the swing unit's azimuth data by using the LIDAR (Light Detection and Ranging) technique of measuring a distance by emitting laser light. The swing unit's azimuth data may be obtained by using a method for scan-matching of scan data.

IMU 24 is a type of angular velocity sensor and provided on swing unit 3. In the present example, IMU 24 is disposed under cab 4. Swing unit 3 is provided with a frame of high rigidity under cab 4. IMU 24 is disposed on the frame. IMU 24 may be disposed sideways (or on a right or left side) of swing axis AX of swing unit 3 (or reference position P2).

IMU 24 measures and outputs azimuthal angular velocity data when swing unit 3 swings. Based on the azimuthal angular velocity data, swing unit 3 is controlled in how it swings. IMU 24 may detect an angle θ4 of rightward/leftward inclination of vehicular body 1 and an angle θ5 of frontward/rearward inclination of vehicular body 1.

Figure 3:
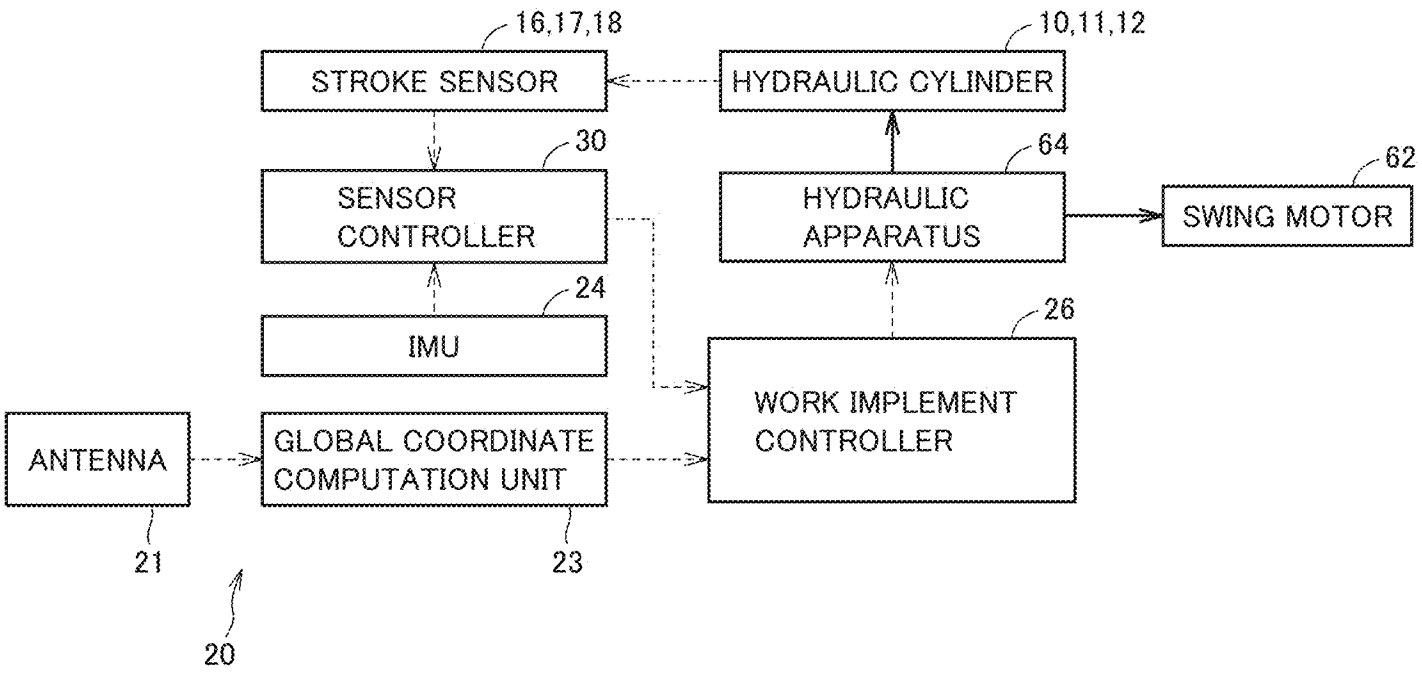
FIG. 3 is a schematic block diagram showing a configuration of a control system of work machine 100 according to an embodiment.

FIG. 3 is a schematic block diagram showing a configuration of a control system of work machine 100 according to an embodiment.

As shown in FIG. 3, work machine 100 includes boom cylinder stroke sensor 16, dipper stick cylinder stroke sensor 17, bucket cylinder stroke sensor 18, antenna 21, global coordinate computation unit 23, IMU 24, work implement controller 26, boom cylinder 10, dipper stick cylinder 11, bucket cylinder 12, a swing motor 62, and a hydraulic apparatus 64.

Hydraulic apparatus 64 includes a hydraulic oil tank, a hydraulic pump, a flow rate control valve, and an electromagnetic proportional control valve (not shown). The hydraulic pump is driven by the power of the engine (not shown), and supplies hydraulic oil to boom cylinder 10, dipper stick cylinder 11, and bucket cylinder 12 via a flow rate regulating valve. The hydraulic pump supplies hydraulic oil to swing motor 62 in order to perform a swinging operation of swing unit 3.

Sensor controller 30 calculates a boom cylinder length based on a result of detection by boom cylinder stroke sensor 16. Boom cylinder stroke sensor 16 outputs to sensor controller 30 a pulse accompanying a periodical operation. Sensor controller 30 calculates a boom cylinder length based on a pulse output from boom cylinder stroke sensor 16.

Similarly, sensor controller 30 calculates a dipper stick cylinder length based on a result of detection by dipper stick cylinder stroke sensor 17. Sensor controller 30 calculates a bucket cylinder length based on a result of detection by bucket cylinder stroke sensor 18.

From the boom cylinder length obtained based on the result of detection by boom cylinder stroke sensor 16, sensor controller 30 calculates an inclination angle θ1 of boom 6 with respect to a direction vertical to swing unit 3. From the dipper stick cylinder length obtained based on the result of detection by dipper stick cylinder stroke sensor 17, sensor controller 30 calculates an inclination angle θ2 of dipper stick 7 with respect to boom 6. From the bucket cylinder length obtained based on the result of detection by bucket cylinder stroke sensor 18, sensor controller 30 calculates an inclination angle θ3 of teeth 8A of bucket 8 with respect to dipper stick 7.

A posture of work machine 100 can be controlled based on inclination angles θ1, θ2, and θ3 as a result of calculation described above, angle θ4 of rightward/leftward inclination of vehicular body 1, angle θ5 of frontward/rearward inclination of vehicular body 1, reference position data P, and the swing unit's azimuth data Q.

Sensor controller 30 outputs to work implement controller 26 azimuthal angular velocity data measured by IMU 24 when swing unit 3 swings.

Global coordinate computation unit 23 outputs the swing unit's azimuth data Q to work implement controller 26.

Based on the swing unit's azimuth data Q received from global coordinate computation unit 23, work implement controller 26 corrects the azimuthal angular velocity data measured by IMU 24, and, based on the corrected azimuthal angular velocity data, controls hydraulic apparatus 64 to control a swing operation of swing unit 3.

Figure 4:
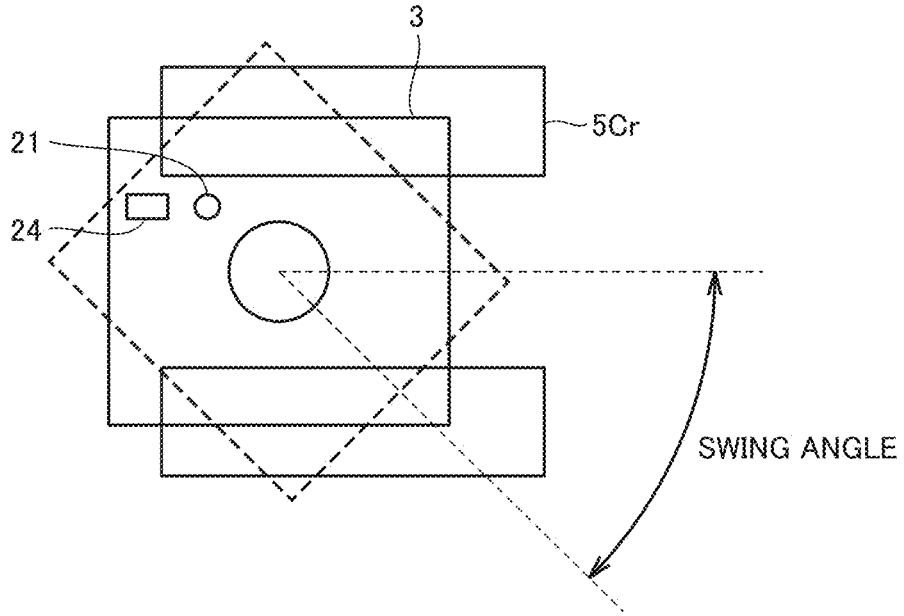
FIG. 4 is a diagram for schematically illustrating a swing operation of a swing unit 3 according to an embodiment.

FIG. 4 is a diagram for schematically illustrating a swing operation of swing unit 3 according to an embodiment. As shown in FIG. 4, swing unit 3 is provided with IMU 24, and IMU 24 measures and outputs azimuthal angular velocity data of swing unit 3.

Work implement controller 26 receives the azimuthal angular velocity data measured by IMU 24 via sensor controller 30.

Work implement controller 26 calculates a swing angle based on the product of the azimuthal angular velocity data measured by IMU 24 and a swing operation time of swing unit 3.

Figure 5:
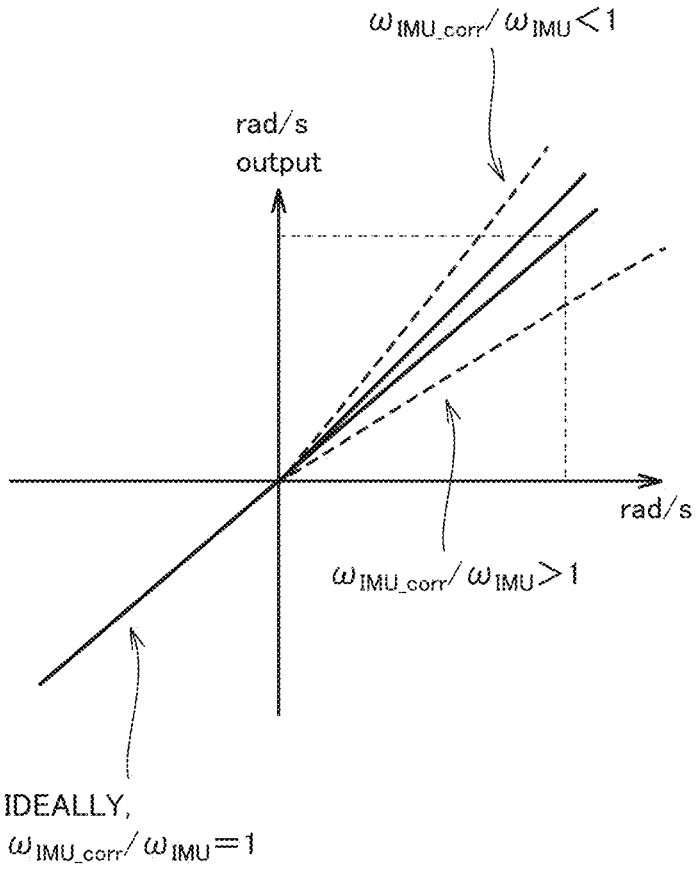
FIG. 5 is a diagram for illustrating a sensitivity error of an IMU 24 according to an embodiment.

FIG. 5 is a diagram for illustrating a sensitivity error of IMU 24 according to the embodiment. FIG. 5 shows a relationship between an actual azimuthal angular velocity data $\omega_{IMU}$ (rad/s) obtained through a swing operation of swing unit 3 and azimuthal angular velocity data $\omega_{IMU_corr}$ measured by IMU 24.

Ideally, a ratio of measured azimuthal angular velocity data $\omega_{IMU_corr}$ to actual azimuthal angular velocity data $\omega_{IMU}$ is "1".

IMU 24 is, however, highly dependent on environment and causes a sensitivity error depending on temperature. Specifically, the figure shows a ratio of measured azimuthal angular velocity data $\omega_{IMU_corr}$ to actual azimuthal angular velocity data $\omega_{IMU}$ being larger or smaller than 1.

Accordingly, in the embodiment, the sensitivity error is measured, and measured azimuthal angular velocity data $\omega_{IMU_corr}$ is corrected to approach the actual azimuthal angular velocity data. In the present example, a correction coefficient is calculated for causing measured azimuthal angular velocity data $\omega_{IMU_corr}$ to approach actual azimuthal angular velocity data $\omega_{IMU}$.

Figure 6:
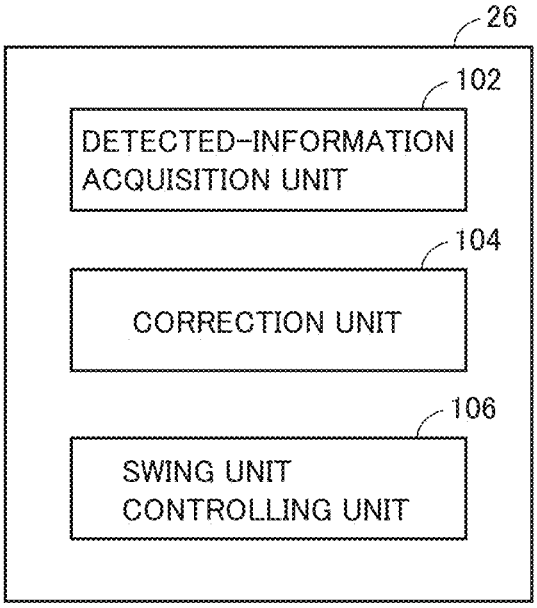
FIG. 6 is a block diagram showing a configuration of a work implement controller 26 according to an embodiment.

FIG. 6 is a block diagram showing a configuration of work implement controller 26 according to an embodiment. As shown in FIG. 6, work implement controller 26 includes a detected-information acquisition unit 102, a correction unit 104, and a swing unit controlling unit 106.

Detected-information acquisition unit 102 obtains azimuthal angular velocity data output from IMU 24 and received via sensor controller 30, and the swing unit's azimuth data output from global coordinate computation unit 23.

Correction unit 104 calculates a correction coefficient for correcting the azimuthal angular velocity data measured by IMU 24, based on the swing unit's azimuth data Q received from global coordinate computation unit 23 and the azimuthal angular velocity data received from IMU 24.

Swing unit controlling unit 106 controls swing unit 3 based on the correction coefficient calculated by correction unit 104 and the azimuthal angular velocity data received from IMU 24.

Figure 7:
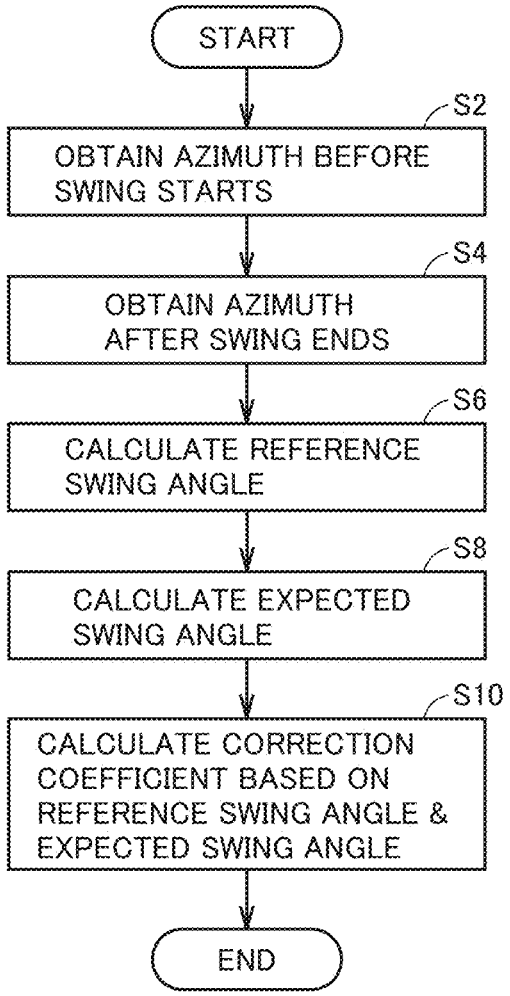
FIG. 7 is a flowchart of calculating a correction coefficient in a correction unit 104 according to an embodiment.

FIG. 7 is a flowchart of calculating the correction coefficient by correction unit 104 according to an embodiment.

As shown in FIG. 7, correction unit 104 obtains azimuth information of swing unit 3 before it starts a swing operation (step S2). For example, the swing unit's azimuth data while work machine 100 is performing an excavating operation before swing unit 3 starts a swing operation is obtained from global coordinate computation unit 23.

Subsequently, correction unit 104 obtains azimuth information of swing unit 3 after it ends the swing operation (step S4). For example, the swing unit's azimuth data while work machine 100 is performing a soil ejecting operation after swing unit 3 ends the swing operation is obtained from global coordinate computation unit 23.

Subsequently, correction unit 104 calculates a reference swing angle (step S6). Specifically, correction unit 104 calculates the reference swing angle based on azimuth information of swing unit 3 before it starts a swing operation and azimuth information thereof after it ends the swing operation, as obtained from global coordinate computation unit 23.

For example, when the swing unit's azimuth data before swing unit 3 starts a swing operation is represented as θswing_start and the swing unit's azimuth data after swing unit 3 ends the swing operation is represented as θswing_goal, a reference swing angle $\theta_{GNSS}$ can be calculated as follows:

$$\text{Reference swing angle } \theta_{GNSS}=\theta\text{swing_goal}-\theta\text{swing_start}.$$

Subsequently, correction unit 104 calculates an expected swing angle (step S8).

Specifically, correction unit 104 calculates an expected swing angle $\theta_{IMU}$ based on azimuthal angular velocity data $\omega_{IMU}$ received from IMU 24 and the swing unit's operation time $t_{swing}$. Expected swing angle $\theta_{IMU}$ can be calculated as follows:

$$\text{Expected swing angle } \theta_{IMU}=\Sigma\omega_{IMU}\times Ts,$$

where Ts: sampling time.

Azimuthal angular velocity data $\omega_{IMU}$ is integrated by the swing unit's operation time $t_{swing}$ elapsing since a swing operation is started until the swing operation ends.

Subsequently, correction unit 104 calculates a correction coefficient (step S10). Specifically, a correction coefficient p is calculated for correcting a sensitivity error of measured azimuthal angular velocity data $\omega_{IMU_corr}$, based on the ratio of expected swing angle $\theta_{IMU}$ to reference swing angle $\theta_{GNSS}$. Correction coefficient p is a rate at which a sensor output of IMU 24 changes depending on an input, and it is calculated by the following equation:

$$\text{Correction coefficient } p=\omega_{IMU_corr}/\omega_{IMU}=\theta_{GNSS}/\theta_{IMU}.$$

The process then ends (END).

Based on correction coefficient p calculated by correction unit 104, swing unit controlling unit 106 corrects the azimuthal angular velocity data measured by IMU 24, and, based on the corrected azimuthal angular velocity data, controls hydraulic apparatus 64 to perform a swing operation of swing unit 3. This allows swing unit 3 to perform a highly accurate swing operation.

As has been described above, work implement controller 26 according to the present embodiment obtains inclination angles θ1 to θ5 from sensor controller 30, reference position data P, and the swing unit's azimuth data Q. Thus, work implement controller 26 can automatically control the posture of work machine 100 based on the obtained information. Specifically, it may automatically control an excavating operation using bucket 8 to excavate an object to be excavated, a hoisting and swinging operation to move the object excavated and held by bucket 8 to a soil ejecting positon, a soil ejecting operation to eject the object excavated and held by bucket 8 in a bed of a dump track, and a descending and swinging operation to move bucket 8 emptied after the soil ejecting operation to an excavating position.

Work implement controller 26 may use the swing unit's azimuth data output from global coordinate computation unit 23 that is obtained during an excavating operation and a soil ejecting operation under automatic control to repeatedly calculate a correction coefficient for correcting azimuthal angular velocity data measured by IMU 24 for use in a hoisting and swinging operation and a descending and swinging operation based on the above-described system.

Alternatively, work implement controller 26 may use an average value of correction coefficients repeatedly calculated as described above. Thus, a highly reliable correction coefficient can be calculated.

Alternatively, work implement controller 26 may calculate a correction coefficient according to reference swing angle $\theta_{GNSS}$. Specifically, when reference swing angle $\theta_{GNSS}$ is equal to or larger than a predetermined angle, a correction coefficient may be calculated because there is a possibility that a large sensitivity error is caused, and whereas when reference swing angle $\theta_{GNSS}$ is less than the predetermined angle, no correction coefficient may be calculated because a relatively small sensitivity error is caused.

Alternatively, work implement controller 26 may perform a testing swing operation for calculating correction coefficient p for correcting azimuthal angular velocity data output from IMU 24. In the testing swing operation, the swing unit's azimuth data generated in global coordinate computation unit 23 before swing unit 3 starts the swing operation and after swing unit 3 ends the swing operation may be used to calculate a correction coefficient for correcting azimuthal acceleration data measured by IMU 24 for use in a swing operation based on the above-described system.

While an embodiment of the present disclosure has been described, it should be understood that the presently disclosed embodiment is illustrative and non-restrictive in any respect. The scope of the present disclosure is defined by the terms of the claims, and is intended to include any modifications within the meaning and scope equivalent to the terms of the claims.

REFERENCE SIGNS LIST

1 vehicular body, 2 work implement, 3 swing unit, 4 cab, 4S operator's seat, 5 traveling apparatus, 5Cr crawler belt, 6 boom, 7 dipper stick, 8 bucket, 8A teeth, 9 engine compartment, 10 boom cylinder, 11 dipper stick cylinder 12 bucket cylinder, 13 boom pin, 14 dipper stick pin 15 bucket pin, 16 boom cylinder stroke sensor, 17 dipper stick cylinder stroke sensor, 18 bucket cylinder stroke sensor, 19 handrail, 20 position detection device, 21 antenna, 21A first antenna, 21B second antenna, 23 global coordination computation unit, 26 work implement controller, 30 sensor controller, 62 swing motor, 64 hydraulic apparatus, 100 work machine, 102 detected-information acquisition unit, 104 correction unit, 106 swing unit controlling unit.

The invention claimed is:

1. A work machine comprising:

a travel unit;

a swing unit provided on the travel unit swingably;

an angular velocity sensor that is attached to the swing unit and outputs an azimuthal angular velocity of the swing unit;

a measurement device that measures an azimuth of the swing unit; and a controller that corrects the azimuthal angular velocity based on the azimuth measured by the measurement device and controls the swing unit based on the corrected azimuthal angular velocity.

2. The work machine according to claim 1, wherein the controller calculates a reference swing angle based on an azimuth of the swing unit as measured by the measurement device before the swing unit starts to swing and an azimuth of the swing unit as measured by the measurement device after the swing unit ends swinging.

3. The work machine according to claim 2, wherein the controller:

calculates an expected swing angle based on the azimuthal angular velocity output by the angular velocity sensor and a swing operation time of the swing unit; and calculates a correction coefficient based on the reference swing angle and the expected swing angle to correct an output of the angular velocity sensor.

4. The work machine according to claim 3, wherein the correction coefficient is a ratio of the expected swing angle to the reference swing angle.

5. A method for controlling a work machine, comprising:

detecting an azimuthal angular velocity by an angular velocity sensor attached to a swing unit provided on a travel unit swingably;

measuring an azimuth of the swing unit;

correcting the detected azimuthal angular velocity based on the measured azimuth of the swing unit; and controlling the swing unit based on the corrected azimuthal angular velocity.

* * * * *